United States Patent [19]

Faillon et al.

[11] 4,173,744

[45] Nov. 6, 1979

[54] IMPEDANCE MATCHED COUPLING DEVICE FOR MICROWAVE TUBES

[75] Inventors: Georges Faillon; Guy Egloff, both of Paris, France

[73] Assignee: Thomson-CSF, Paris, France

[21] Appl. No.: 827,087

[22] Filed: Aug. 23, 1977

[30] Foreign Application Priority Data

Aug. 27, 1976 [FR] France ..... 76 25955

[51] Int. Cl.[2] ..... H01P 5/02; H01J 23/32

[52] U.S. Cl. ..... 333/33; 333/175; 315/39.53

[58] Field of Search ..... 333/33, 76, 98 P; 315/5.39, 39.53

[56] References Cited

U.S. PATENT DOCUMENTS

| | | | |
|---|---|---|---|
| 2,748,351 | 5/1956 | Varnerin, Jr. | 333/98 R X |
| 2,967,973 | 1/1961 | Vaccaro | 315/39.53 |

FOREIGN PATENT DOCUMENTS

| | | | |
|---|---|---|---|
| 657607 | 9/1951 | United Kingdom | 333/33 |

OTHER PUBLICATIONS

Southworth, *Principles and Applications of Waveguide Transmission,* Van Nostrand Co., N.J., 1950, pp. 97, 105, 134, 135 & title page.

*Primary Examiner*—Paul L. Gensler
*Attorney, Agent, or Firm*—Roland Plottel

[57] ABSTRACT

A coupling device for a microwave tube including a first length of waveguide and a second length of waveguide of rectangular cross-section. The two lengths of waveguide are connected together and have their free ends coupled when operating to a load and to the tube respectively. The large side of the cross-section of the second length of waveguide is equal and parallel to the corresponding side of the first length of waveguide. The small side of the cross-section of the second waveguide is several times smaller than the corresponding side of the first waveguide. Two connected lengths of waveguide form a transition. The first waveguide contains an iris and the coupling device forms an assembly of matched impedance.

6 Claims, 7 Drawing Figures

Figure 1:
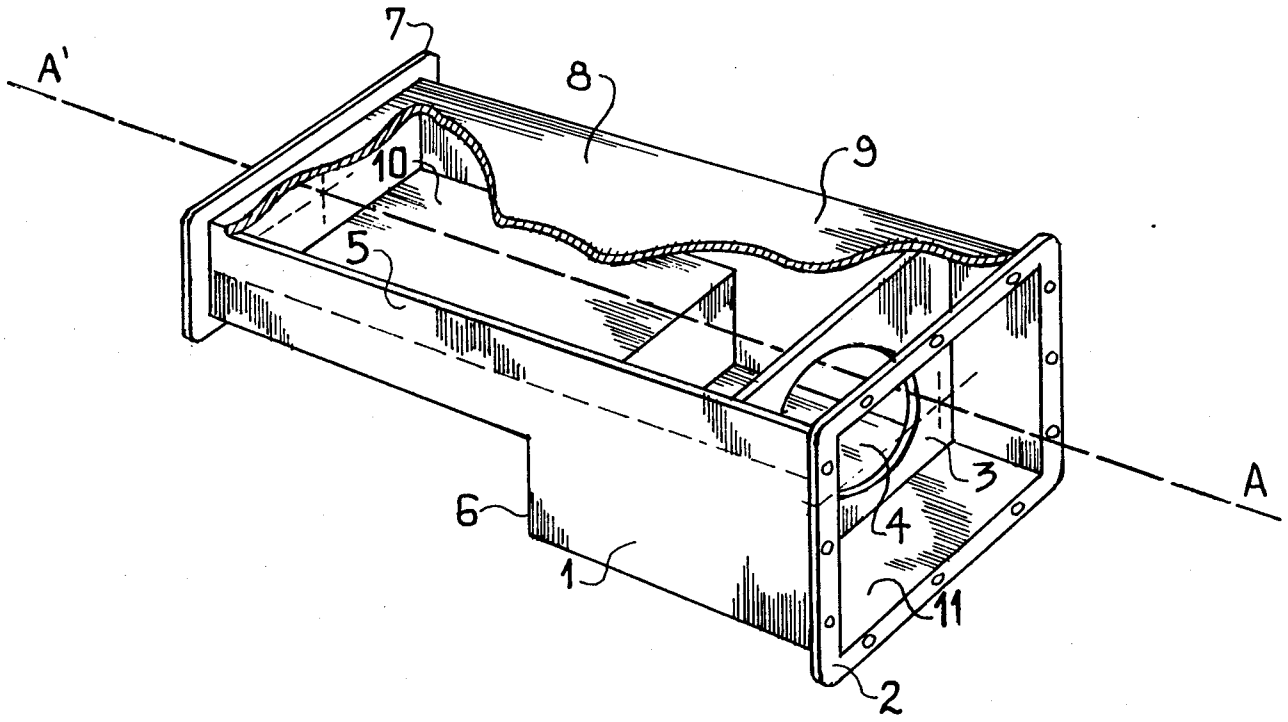

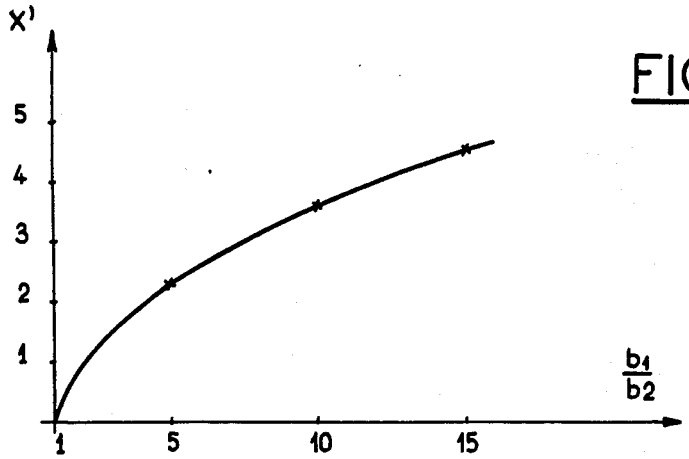
FIG. 5a
FIG. 5b
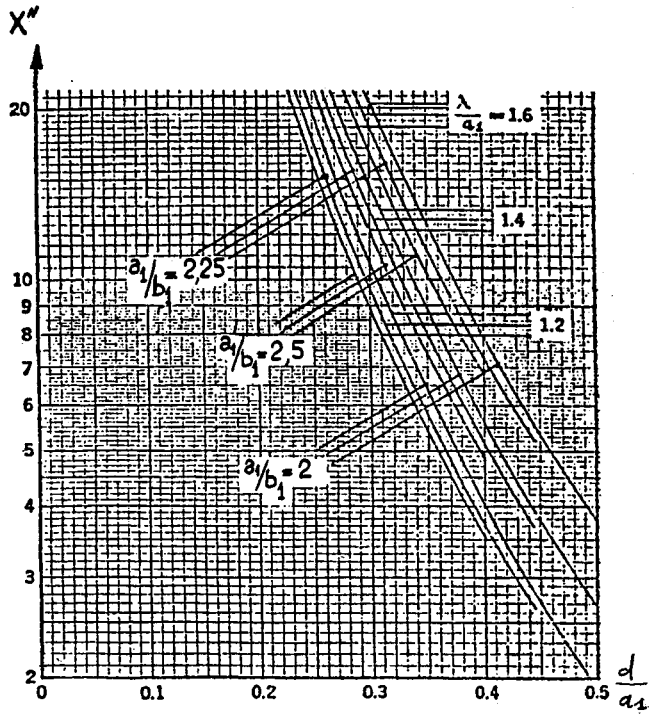

IMPEDANCE MATCHED COUPLING DEVICE FOR MICROWAVE TUBES

The present invention relates to a coupling device for microwave tubes.

Microwave tubes, such as klystron tubes for example, employ for their operation a beam of electrons which is focussed by a magnetic field which is parallel to it. The speed of the electron beam is modulated by a microwave input field. This modulation is converted into a density modulation as the electron beam passes through a series of drift tubes which connect together the resonant cavities of the tube. The final cavity is coupled to an output waveguide via a microwave window through which the microwave energy is transmitted.

If the electron beam is to be properly focussed and if it is to be of virtually constant diameter along the whole of its path, a magnetic focussing field has to be present and free of any major disruption along the entire path of the electron beam.

This magnetic field is generally produced by a focussing device such as a magnet or an electro-magnet, which is connected to the tube by body-of-revolution pole pieces, in particular at the point where the final cavity or output cavity and/or the exit window and the associated device are situated. The exit window of the tube and the coupling device which is associated with it pose the problem that the coupling device passes either through the actual focussing device or through the pole pieces, as well as the problem of disturbing the focussing field. The consequence of defocussing the electron beam at its end would be to make it possible to optimize the characteristics of the microwave tube such as its output and its pass band. In addition a defocussed electron beam causes, as a result of the defocussed electrons being intercepted by the body of the tube, a reduction in or restriction of the mean or continuous output power from the tube in operation.

A known solution to this problem is to use an output waveguide of rectangular cross section which is of relatively small size in a direction parallel to the focussing axis of the microwave tube in order not to restrict the height of the winding of the electro-magnet or of the focussing device at this point and to minimize the disruption of the magnetic focussing field at the point where the coupling device is situated.

However, conventional coupling devices which employ output waveguides of rectangular cross-section are connected to a window or waveguide of circular cross-section which contains a transverse disc of di-electric material which is responsible for sealing the coupling device and transmitting the microwave signals. When the frequency of the transmitted signals is low, in the C, S and L bands for example, the coupling devices of this kind which are used have specific standard dimensions. In the L band for example the diameter of the circular guide is close to 184 mm and the dimensions of the rectangular guide are 165.1 mm×82.55 mm. Where the operating frequency of the tube is 500 MHz, the standard diameter of the circular waveguide is 510 mm and the dimensions of the standard rectangular guide are approximately 460 mm×230 mm. These dimensions, given the ratio between the cross-sectional dimensions of the standard rectangular guides which is close to 1:2, are much too large to avoid the previously mentioned disadvantages.

When the transmitted power is large and the frequencies high, use is also made of coupling devices which consist of a rectangular output guide equipped with an iris consisting of a metal plate transverse to the waveguide which has the same dimensions as the inside dimensions of the waveguide and contains an orifice blocked by a dielectric material. Such coupling devices have the drawback of being fundamentally mismatched, which has to be compensated by arranging additional capacitive or inductive obstructions in the outlet guide on either side of the iris. These obstructions are difficult to produce and prevent the dimensions of such coupling devices from being optimized.

Coupling devices having co-axial outputs are equally bulky and limited as to power and do not allow the above problem to be solved.

The present invention enables the aforementioned disadvantages to be overcome and has an object a coupling device for microwave tubes which is made up of two lengths of rectangular-section waveguide which are connected together, with one of the two lengths, termed the first length, and the other, termed the second length, being coupled, in operation, at their free ends to a load and the said tube respectively, the said first length containing an iris and the large size of the cross-section of the said second length being equal and parallel to the large side of the said first length, the small side of the cross-section of the second length being several times smaller than the small-side of the cross-section of the first length, and the connection between the two lengths of waveguide forming a transition.

By providing a special coupling device, the present invention enables the size of the coupling device to be reduced in the direction in which the electron beam of the microwave tube is focussed, and enables the above mentioned disadvantages to be overcome. The device which is the subject of the invention also allows an iris-equipped coupling system to be used without the necessity for matching impedance by using additional obstructions.

In addition, the mechanical strength of the iris is improved by the device which is the subject of the invention by virtue of the reduction in the geometrical dimensions of the iris which acts as a microwave window.

The coupling device for microwave tubes which is the subject of the invention is capable of being used in particular for coupling the output cavities of very high power and high output klystrons which operate, for example, in the frequency range between 500 and 1200 MHz. Broadly speaking, the invention is applicable to any apparatus such as a microwave tube, particle accelerator, etc., which requires a coupling device which causes little disruption to the focussing field.

In accordance with the invention, the various parameters which determine the geometrical shape and thus the electrical characteristics of the transition and the iris are so adjusted that the combination formed by the iris and by the transition represented by the connection between the two lengths of waveguide forms an assembly of matched impedance. Because of its electrical characteristics, the iris has a positive reactance of an inductive nature. The transition on the other hand has a negative reactance which is capacitive. The transition between the two lengths of waveguide is formed by a connection between two lengths of waveguide of rectangular cross-section whose large sides are equal and of which the small side of one is very much smaller than the small side of the other. The connection between the two lengths is such that the large sides and the small sides of the cross-section of each length of guide are parallel to one another. The impedance of the assembly is matched when the reactance of the impedance of the coupling device as a whole is reduced to zero by compensating the reactances of an inductive and capacitive nature of the iris and the transition. In view of the standard dimensions of the first length for coupling to the load, if the iris is to be matched by means of the transition between the two waveguides this entails a reduction in the size of the tube and results in the removal of the aforementioned disadvantages relating to focussing.

Figure 2:
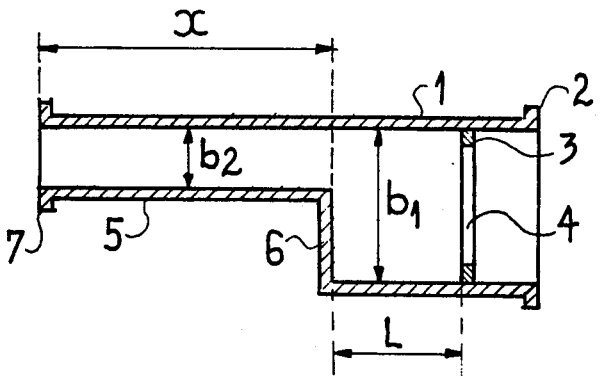
Figure 3:
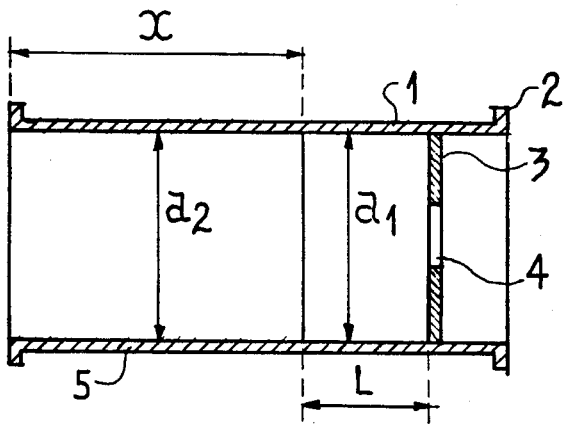
Figure 4:
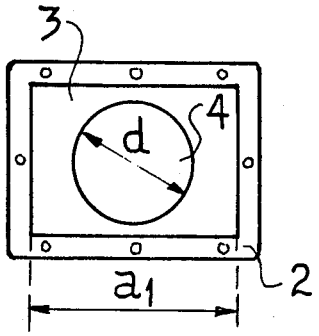
Figure 6:
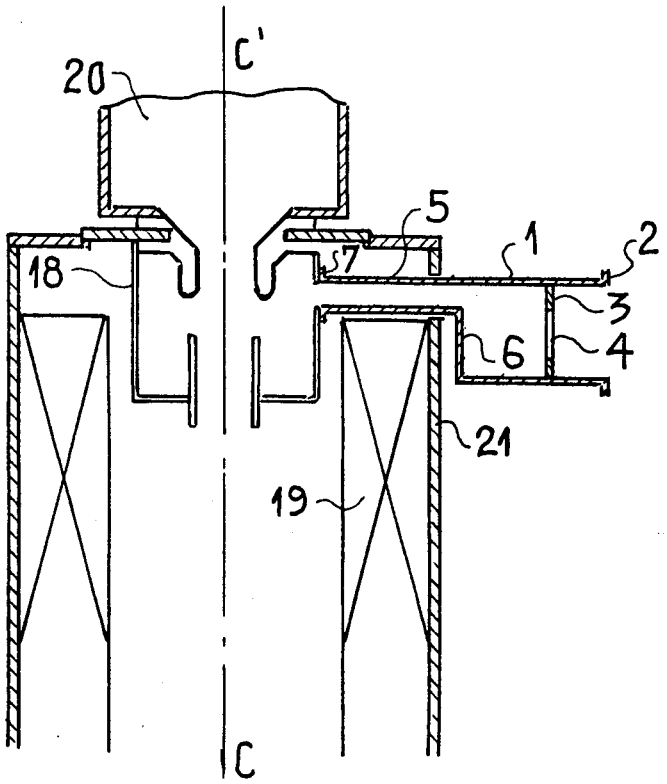

The invention will be better understood from the following description and the accompanying drawings, in which the same reference numerals refer to similar components and in which:

FIG. 1 is a cut-away perspective view of an embodiment of the subject of the invention, FIG. 2 is a side view, in longitudinal section on plane P1 of FIG. 1, FIG. 3 is a view from above in cross-section on plane P2 on FIG. 1, FIG. 4, is an end-on view of the device which is the subject of the invention in the direction AA' shown in FIG. 1, FIG. 5, shows at 5*a* and 5*b*, curves for the change in the reactance of the transition and the iris respectively as a function of their dimensions, FIG. 6, is a sectional view of a microwave tube of the klystron type fitted with the coupling device according to the invention, The dimensions and thicknesses of the component parts of the subject of the invention are not shown in their correct relative proportions in the drawings to enable the drawings to be better understood.

In FIG. 1, the non-limiting embodiment of the device which is the subject of the present invention includes a first waveguide 1. The first waveguide 1 is provided with an outlet flange 2 which enables the waveguide 1 to be coupled to the load. In one of its cross-sectional planes the waveguide 1 contains an iris 3 which is formed by a metal plate provided with an orifice 4 blocked by a sheet or disc of dielectric material. The iris is responsible for transmitting the microwave signals and for providing a seal between the two media which it divides. The first waveguide is connected to a second waveguide 5 of similar rectangular cross-section whose large sides are equal to the large sides of the cross-section of the first waveguide and whose small sides are a number of times smaller than the small sides of the first waveguide. The connection between the two waveguides 1 and 5 is such that large sides and the small sides of the cross-section of each length of guide are mutually parallel. In the embodiment of FIG. 1, two of the side faces 8 and 9 of the waveguides 1 and 5 which are defined by a large side of the cross-section of the waveguide lie in the same plane, the side-faces 10 and 11 being at different levels from one another and thereby forming the connecting transition 6 between the two guides. A connecting transition which includes two differences of level, which two differences of level are either equal or not equal, also falls within the scope of the present invention. The connecting transition, which is formed in the embodiment shown in FIG. 1 by an abrupt change in the size of the small-sides at the point where waveguide 1 merges into waveguide 5, could also be formed by a gradual change in this size without exceeding the scope of the present invention.

Because of its electrical characteristics, the iris 3 has a reactance which is equal for example to jX". The transition 6 has a reactance which is equal to-jX' for example. The device is matched in particular when X' and X" are, preferably, equal in value. In this particular case, a match is produced when the distance L separating the iris and the transition is such that $L=\lambda g/2$, where λg is the wavelength of the microwave signal in the waveguide.

In more general terms, the device is matched, for particular values of the reactance of the iris and of the transition and of the distance separating these two items, whenever the impedance at the end of the transition 6 lying nearer the tube has zero reactance.

The way in which the device operates, and its characteristics, will be explained with reference to FIGS. 2, 3, 4 and 5. As shown in FIG. 2, the small sides of the cross-section of the first waveguide 1 are represented by b1 and those of the second waveguide by b2. The iris 3 is at a distance of L from the transition 6 formed by the connection between the two waveguides 1 and 5, which distance is equal to one half wavelength of the microwave signal in the guide or to a multiple of this half wavelength.

In FIG. 3 the major dimensions of the first waveguide 1 and of the second waveguide 5 are represented by a1 and a2 respectively. These two dimensions are equal.

In FIG. 4, which shows a non limiting embodiment of the subject of the present invention, the iris 3 contains a circular orifice 4 of diameter d.

In FIG. 5, FIG. 5*a* shows the change in the reactance of the transition as a function of the ratio b1/b2 between the small dimensions of the guides. The abscissa in FIG. 5*a* is graduated in values of the ratio b1/b2 and the oridinate in relative value of the reactance of the transition referred to the characteristic impedance of the first waveguide. FIG. 5*b* shows the change in the reactance of the iris as a function of parameters such as the diameter of the orifice d, when the orifice is circular, the free wavelength of the microwave signal in a vacuum, and the ratio a1/b1 between the cross-sectional dimensions of the first wave-guide. The abscissa in FIG. 5*b* is graduated in values of the ratio d/a1 and the ordinate in relative values of the reactance of the iris referred to the characteristic impedance of the guide.

Non-limiting embodiments of the subject of the invention have given the following results:

First embodiment frequency of microwave signals: $F=1500$ MHz waveguide 1: standard waveguide (165.1 mm×82.5 mm)

$$b1/a1=\tfrac{1}{2}$$

distance between iris and transition: $L=\lambda g/2=125.5$ mm diameter of the iris: $d=80$ mm λ=free wavelength $$\lambda/a1=1.2\ d/a1=0.485\ \lambda=199.8\text{ mm}$$

in FIG. 5*b*; X"=2.1 in FIG. 5*a*, X'=2.1, giving b1/b2=4.8 and b2=17.2

The dimension of the small sides of the cross-section of the waveguide 5 for coupling to the tube is smaller than the corresponding dimension of the standard guide by a factor of close to 5.

Second embodiment frequency of microwave signals: F=500 MHz $\lambda=599.5$ waveguide 1:

standard waveguide (457.2 mm×228.6 mm)

$b1/a1=\frac{1}{2}$ distance between iris and transition: $L=\lambda g/2=397$ mm diameter of iris d=225 mm $\lambda/a1=1.3$ $d/a1=0.5$ in FIG. 5*b*, X″=2.3 in FIG. 5*a*, X′=2.3 giving b1/b2=5.1 and b2=45 mm.

The dimension of the small sides of the cross-section of the waveguide 5 for coupling to the tube is smaller than the corresponding dimension of the standard tube by a factor greater than 5.

In the embodiments which are shown, the iris 3 contains a circular orifice 4. However, an iris which has an elliptical or rectangular orifice or one of any shape whatever which allows the reactance of the iris to be determined and to be compensated by a transition may be used for practicing the present invention and does not exceed its scope. In general terms, the iris is formed by a metal plate 3 provided with an orifice 4. The orifice 4 is bloked by a sheet or disc of dielectric material, such as alumina, glass or glucina, which provides a seal between the two media at different pressures which are divided by the iris.

The thickness of the sheet or disc of dielectric material is made such that it is capable of withstanding a pressure differential of 5 kg/cm$^2$ for example. Thus, in the first embodiment an alumina disc of 80 mm diameter and of a thickness e=2.66 mm will support a pressure differential of the order of 5.5 kg/cm$^2$ whereas, under the same operating conditions, a disc of the same thickness contained by a conventional coupling device would require a diameter equal to 184 mm and would only withstand a pressure of the order of 1 kg/cm$^2$.

The advantages which the device which is the subject of the present invention affords from the mechanical point of view will be realized.

Because the value of L is equal to $\lambda g/2$, the coupling device which is the subject of the invention has a narrow pass band and, the system being considered as matched with a voltage standing-wave ratio of less than 1.15, the pass band is approximately 12 MHz in the case of the first embodiment and approximately 4 MHz in the case of the second embodiment. The device thus behaves as a filter for the harmonics which are produced in particular by the microwave tube, since the length L which is given by $\lambda g/2$ at the central transmission frequency of the tube is not a whole-number multiple of the wavelength of the harmonic frequencies in the tube due to the fact it does not vary linearly with the frequency of the signals.

FIG. 6 shows a non-limiting example of an output coupling to a tube of the klystron kind which is produced by means of an arrangement which is the subject of the invention. The coupling device is coupled to the final cavity 18 of the klystron tube by a coupling flange 7. the device is coupled in such a way that small sides of the cross-section of the coupling guide 5 are orientated in a direction parallel to the direction of the magnetic field for focussing the electron beam being received CC′ in the present case, the electron beam being received in this case by the collector 20 of the klystron. The magnetic circuit 21 and the focussing means 20 have a minimum amount of asymmetry because of this and the fact of the coupling guide 5 passing through the magnetic circuit does not cause any appreciable disturbance to the field for focussing the electron beam.

The klystron tube shown is a power klystron-tube. The limits on the power which can be transmitted by the coupling device which is the subject of the invention are related to the size of the small sides of the cross-section of the coupling waveguide 5, the said size having to be adequate to ensure that no electrical arcing can take place in the guide. Nevertheless, calculation shows that, in the case of the first embodiment where b2=17.2 mm, the maximum power which can be transmitted by the device is of the order of 80 MW. This value is not a restriction in conventional applications of the subject of the invention, such as to microwave heating devices radars and particle accelerators.

We claim:

1. A coupling device for a microwave tube made up of two waveguides of rectangular cross-section which are connected together, one of the two waveguides termed the first waveguide and the other termed the second waveguide being coupled in operation at their free ends to a load and to said tube respectively, wherein said first waveguide contains an iris, formed by a metal plate which is pierced by an orifice blocked by a sheet of dielectric material, and said second waveguide has a cross-section whose length is equal and parallel to the length of said first waveguide, the width of the cross-section of the second waveguide being several times smaller than the width of the cross-section of the first waveguide, and the connection between the two waveguides forming a transition, a distance L separating the iris from the transition and the reactance of the iris being such that the impedance at the end of the transition nearer the tube has zero reactance, said iris being placed at said distance L from the transition equal to a multiple of half wavelengths of the microwave transmitted by the first guide.

2. A coupling device according to claim 1, wherein the connection which forms the transition between the two waveguides is formed by a wall perpendicular to the large sides of the guide.

3. A device according to claim 1, wherein said sheet of dielectric material is glucina.

4. A device according to claim 1, wherein said sheet of dielectric material is glass.

5. A device according to claim 1 wherein said sheet of dielectric material is alumina.

6. A coupling device according to claim 1, wherein the said iris is placed at a distance $L=\lambda_g/2$ from the transition, where $\lambda_g$ is the wavelength of the microwave signal transmitted by the first waveguide.

* * * * *